US011771194B2

(12) United States Patent
Wojczak

(10) Patent No.: US 11,771,194 B2
(45) Date of Patent: Oct. 3, 2023

(54) HAIR BAND APPARATUS

(71) Applicant: CONAIR CORPORATION, Stamford, CT (US)

(72) Inventor: Sophia Wojczak, Weehawken, NJ (US)

(73) Assignee: Conair LLC, Stamford, CT (US)

( * ) Notice: Subject to any disclaimer, the term of this patent is extended or adjusted under 35 U.S.C. 154(b) by 995 days.

(21) Appl. No.: 15/139,946

(22) Filed: Apr. 27, 2016

(65) Prior Publication Data

US 2017/0311691 A1 Nov. 2, 2017

(51) Int. Cl.
*A45D 8/36* (2006.01)

(52) U.S. Cl.
CPC ..... *A45D 8/36* (2013.01)

(58) Field of Classification Search
CPC ..... A45D 8/36; A45D 2008/004; A45D 8/00; A45D 8/34; A45D 8/12; A45D 2008/002; A45D 2008/006; A45D 2008/345
USPC ..... 132/213
See application file for complete search history.

(56) References Cited

U.S. PATENT DOCUMENTS 248,542 A * 10/1881 Wilson ..... A45D 8/12 132/200
937,223 A 10/1909 Burke
1,406,819 A 2/1922 Bechtold
1,451,562 A 4/1923 Babcock
1,532,495 A * 4/1925 Jensen ..... A45D 8/36 2/174
1,584,329 A * 5/1926 Skaruda ..... A45D 8/36 132/130
2,604,101 A * 7/1952 Helfgott ..... A45D 24/34 132/144
2,868,214 A 1/1959 Levy
D205,576 S 8/1966 Day
3,467,111 A 9/1969 Benson
5,449,008 A 9/1995 Yeh
5,458,108 A 10/1995 Jacobs
D380,865 S 7/1997 Shing
5,697,386 A 12/1997 Chang
5,822,798 A 10/1998 Baxley
5,826,597 A 10/1998 Chou
5,913,316 A 6/1999 Chou
5,927,296 A 7/1999 Maturaporn
5,937,872 A 8/1999 Wang
6,024,102 A * 2/2000 Huang ..... A45D 8/36 132/273
6,047,709 A 4/2000 Tu
(Continued)

*Primary Examiner* — Rachel R Steitz
*Assistant Examiner* — Brianne E Kalach
(74) *Attorney, Agent, or Firm* — Ruggiero McAllister & McMahon LLC

(57) ABSTRACT

A hair band apparatus adapted to retain a subject's hair in a desired orientation away, e.g., from the face, and simultaneously impart a part in the subject's hair to enhance desired styling effects, includes a hair band member configured for positioning relative to a head of a subject, and being arranged about a central axis, and a single parting member mounted to the hair band member. The single parting member is configured to impart a part in the subject's hair while mounting the hair band member to the subject's head. The single parting member may be centrally located on the hair band member to provide a central part or be offset to provide a side part.

20 Claims, 4 Drawing Sheets

(56) References Cited

U.S. PATENT DOCUMENTS 6,513,167 B1 * 2/2003 Cheng ..... A45D 8/36 2/209.13
6,584,984 B2 7/2003 Kelly
D537,984 S 3/2007 Steudle et al.
D603,584 S * 11/2009 Porter ..... D28/41
D654,623 S 2/2012 Hsu
8,166,982 B2 5/2012 Hsu
8,360,077 B2 1/2013 Defenbaugh et al.
8,794,248 B2 8/2014 Defenbaugh et al.
D935,694 S * 11/2021 Hinds ..... D28/41
2002/0117182 A1 * 8/2002 Silva ..... A45D 8/00 132/273
2008/0169001 A1 7/2008 Shyu
2008/0283082 A1 * 11/2008 Jagemann ..... A45D 8/36 132/273
2009/0090378 A1 4/2009 Chudzik et al.
2009/0145455 A1 6/2009 Saponaro
2009/0277468 A1 11/2009 Hsu
2010/0000565 A1 1/2010 Saylor-Marchant
2010/0018544 A1 1/2010 Hsu
2010/0180910 A1 7/2010 Hsu
2012/0260935 A1 10/2012 Lalonde et al.
2012/0266909 A1 10/2012 Tsai
2013/0042880 A1 * 2/2013 Arpey ..... A45D 8/12 132/200
2013/0263879 A1 * 10/2013 Munoz-Hunt ..... A45D 8/38 132/213
2014/0193021 A1 * 7/2014 Bailey ..... H04R 1/028 381/378
2015/0133762 A1 * 5/2015 Hayakawa ..... A61B 5/4815 600/383
2016/0015144 A1 * 1/2016 Johnson ..... A45D 8/36 2/209.3
2016/0058152 A1 * 3/2016 Purkey ..... A45D 8/38 132/273
2016/0213121 A1 * 7/2016 Rice ..... A45D 8/36
2019/0021466 A1 * 1/2019 Earhart ..... A45D 8/30
2022/0142279 A1 * 5/2022 Young ..... A41G 5/0073

* cited by examiner

Side Detail view

Front

HAIR BAND APPARATUS

BACKGROUND

1. Technical Field

The present disclosure relates to a hair band apparatus, and, in particular, to a hair band apparatus having a parting feature to impart a part in a subject's hair.

2. Background of the Related Art

Head or hair bands are well known in the art and are developed to assist people in creating desirable hair decorative arrangements. Hair bands may be traditionally C-shaped devices which surround a portion of a subject's head to hold hair in place, often times, away from the face. Hair bands may be fabricated from a suitable elastomer, polymeric material and/or a metallic material and exhibit a degree of flexibility to fit around various size heads.

SUMMARY

Accordingly, the present disclosure is directed to a hair band apparatus adapted to retain a subject's hair in a desired orientation away, e.g., from the face, and simultaneously impart a part in the subject's hair to enhance desired styling effects. In one embodiment, a hair band apparatus includes a hair band member configured for positioning relative to a head of a subject, and being arranged about a central axis and a single or sole parting member mounted to the hair band member. The single parting member is configured to impart a part in the subject's hair while mounting of the hair band member about the subject's head.

The single parting member includes a divider segment which generally extends along the longitudinal axis of the hair band member and may be tapered to facilitate separating hair strands as the single parting member passes thought the subject's hair. The divider segment may define a cross-section which increases from a first or leading end remote from the hair band member to a second or trailing end proximal the hair band member. The divider segment may define a general triangular cross-section.

The divider segment is disposed radially inwardly from the hair band member relative to the central axis of the hair band member. The single parting member may include a connector segment coupled to the hair band member with the divider segment depending from the connector segment. The single parting member may be substantially L-shaped in plan. In an embodiment, the single parting member is centrally located relative to the hair band member.

The single parting member is secured to the hair band member. In the alternative, the single parting member is mounted for movement along the hair band member to vary a location of the part imparted in the patient's hair.

Other advantages of the present disclosure will be appreciated from the following description.

BRIEF DESCRIPTION OF THE DRAWINGS

Various embodiments of the present disclosure are described hereinbelow with references to the drawings, wherein.

DETAILED DESCRIPTION

Referring now in detail to the drawings and, in particular, to FIGS. 1-4, the hair band apparatus 100 in accordance with the principles of the present disclosure is illustrated. The hair band apparatus 100 is adapted to both retain a subject's hair "h" in a desired relation to the subject's face and also impart a part in the hair "h" to, e.g., highlight features of your hair and face. The hair band apparatus 100 may desirably continually maintain the part in the hair during use.

The hair styling apparatus 100 includes a head or hair band member 102 which, in one embodiment, is general C-shaped or U-shaped to span across the subject's head. In one embodiment, the hair band member 102 is arranged, e.g., symmetrically arranged about a central longitudinal axis "k" extending through the opening 104 created or defined by the hair band member 102. The hair band member 102 may be formed of a suitable elastomer, polymeric material and/or metallic material, and may have surface decorations to enhance its visual appearance. The hair band member 102 has sufficient flexibility to stretch or bend to accommodate heads of varying sizes and preferably returns to its normal condition in response to the inherent resiliency of its material of fabrication.

Figure 4:
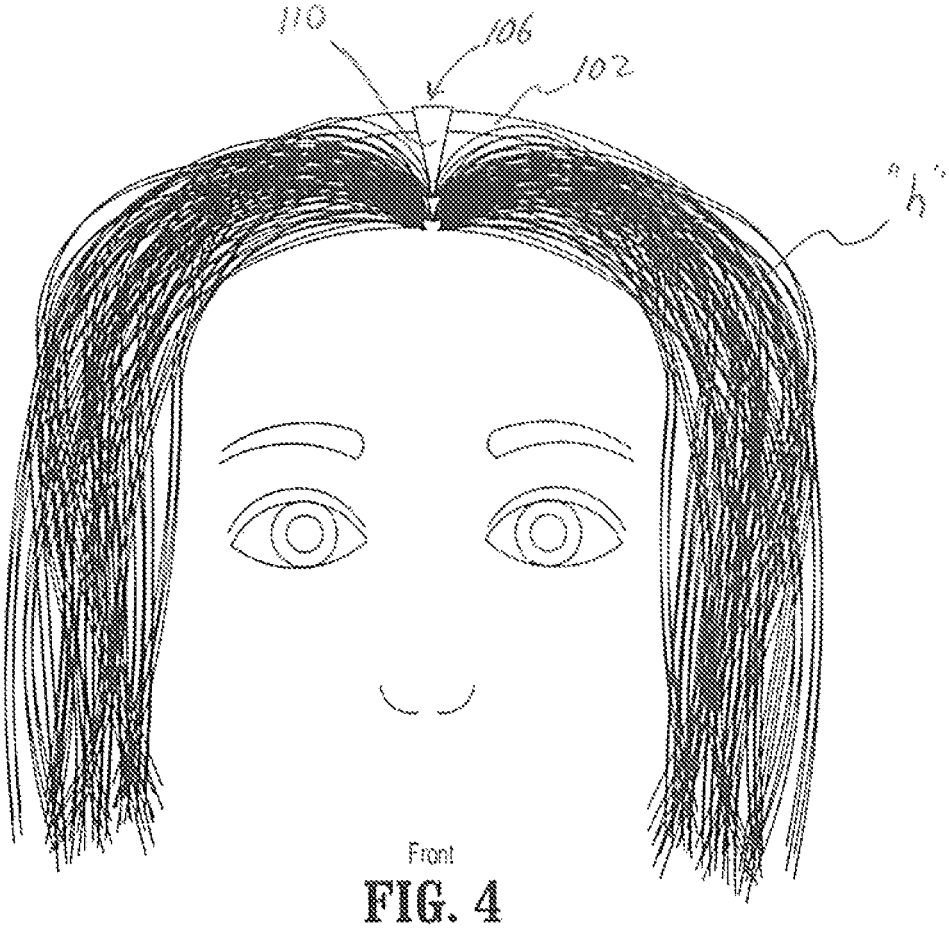
FIG. 4 is a view illustrating the hair band apparatus mounted about the head of a subject and depicting the part in the hair created by the parting member.

The hair styling apparatus 100 also includes a parting member 106 which is secured to the hair band member 102 through any conventional means. For example, the parting member 106 may be a separate component secured to the hair band member 102 through adhesives, fasteners or the like, or may be monolithically formed with the hair band member 102 during manufacture, e.g., during a molding process. The parting member 106 may be centrally located on the hair band member 102, e.g., equidistally disposed relative to the band ends 108 to create, establish or impart a central part within the subject's hair "h" as depicted in FIG. 4. Alternatively, the parting member 106 may be disposed along other sections of the hair band member 102 to establish side parts within the subject's hair "h" to create other styling arrangements.

Figure 1:
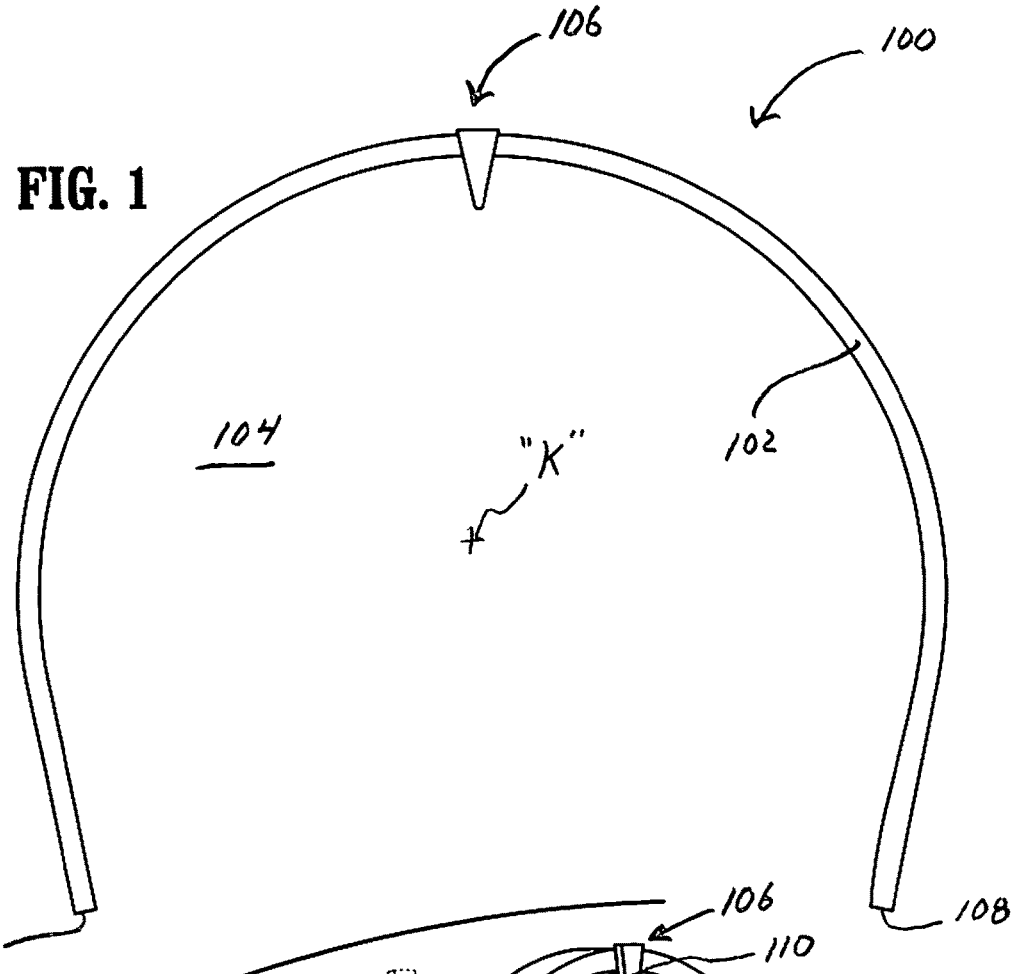
FIG. 1 is a plan view of the hair or head band apparatus in accordance with the principles of the present disclosure illustrating the hair band member and the parting member.
Figure 2:
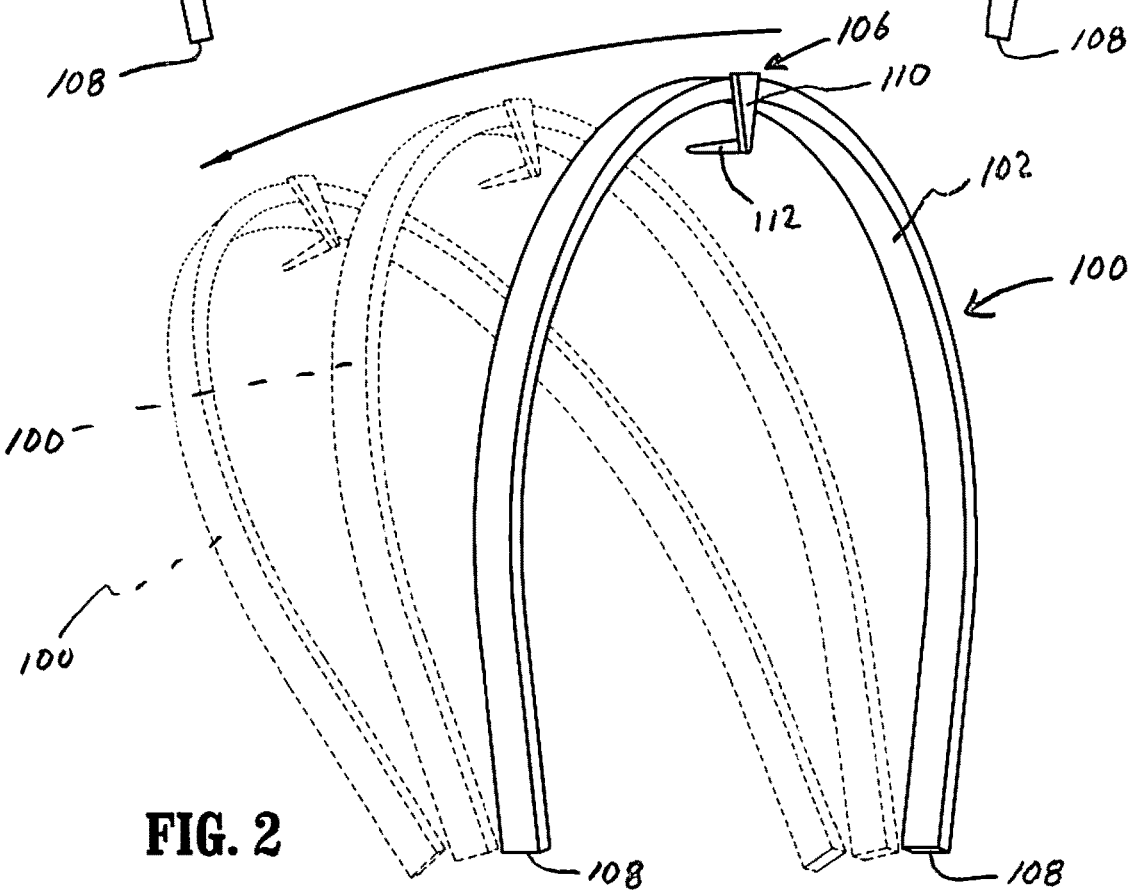
FIG. 2 is a perspective view of the hair band apparatus with some of the apparatuses depicted in phantom illustrating a path of movement along the head of the subject.
Figure 3:
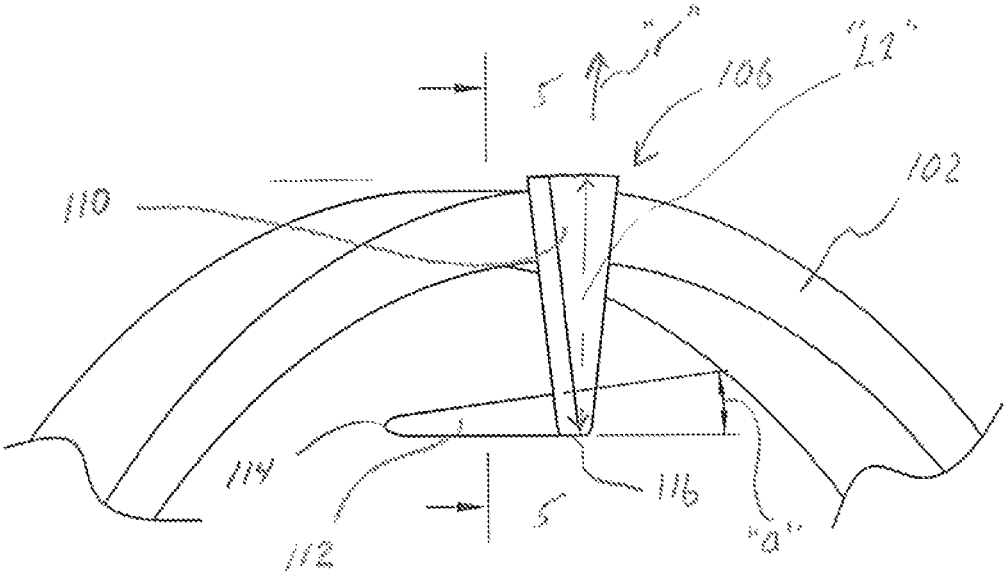
FIG. 3 is an enlarged perspective view illustrating the parting member secured to the hair band member.
Figure 5:
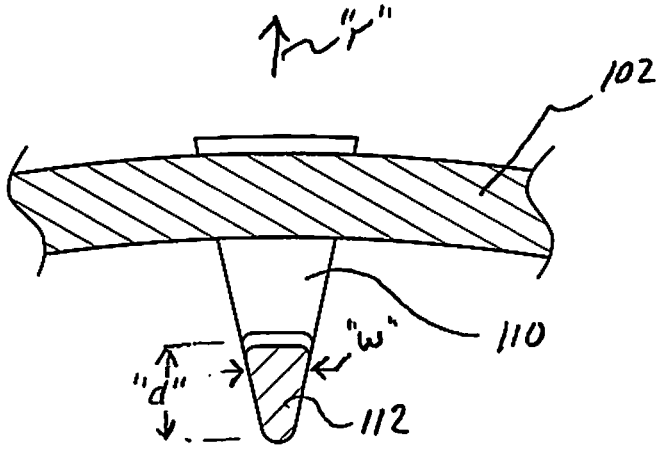
FIG. 5 is a cross-sectional view taken along the lines 5-5 of FIG. 3 illustrating the configuration of the parting member.

With reference to FIGS. 3 and 5, in conjunction with FIG. 2, the parting member 106 will be discussed. The parting member 106 includes a connector segment 110 and a divider segment 112, which, in combination define a general "L"-shape configuration in plan view. The connector segment 110 is connected, coupled or formed with the hair band member 102. The connector segment 110 may define a length "l1" ranging from about a ⅛ inch to about a ½ inch although other dimensions are contemplated depending on the thickness of the subject's hair "h". It is also envisioned that the connector segment 110 may be slidably movable in a vertical or radial direction "r" relative to the central longitudinal axis "k" to vary the effective length of the connector segment 110 relative to the hair band member 102 to accommodate varying hair thickness. One skilled in the art may envision various mechanisms to achieve this objective.

The divider segment 112 depends at a right angle relative to the connector segment 110 although other angular orientations are envisioned. The divider segment 112 is disposed radially inwardly of the hair band member and extends along the central longitudinal axis "k" (e.g., in a direction generally parallel to the longitudinal axis "k"), and defines a first or leading end 114 connected to the connector segment 110 and a second or trailing end 116 remote from the connector segment 110. As best depicted in FIG. 3, in one embodiment, the divider segment 112 defines a cross-section which increases from the first end 114 to the second end 116, e.g., the divider segment 112 tapers at an angle "a" toward the first end 114. This arrangement facilitates the initial parting process within the subject's hair "h", and gradually separates the hair to form the complete part as the hair band member 102 is dragged or maneuvered from the front to the back of the patient's head. The cross-section of the divider segment 112 may increase in both height "d" and width "w" from the first end 114 to the second end 116. In one embodiment, the divider segment 112 may be triangular in cross-section. The first or leading end 114 may be blunt to avid penetration of the scalp of the subject's head.

Figure 6:
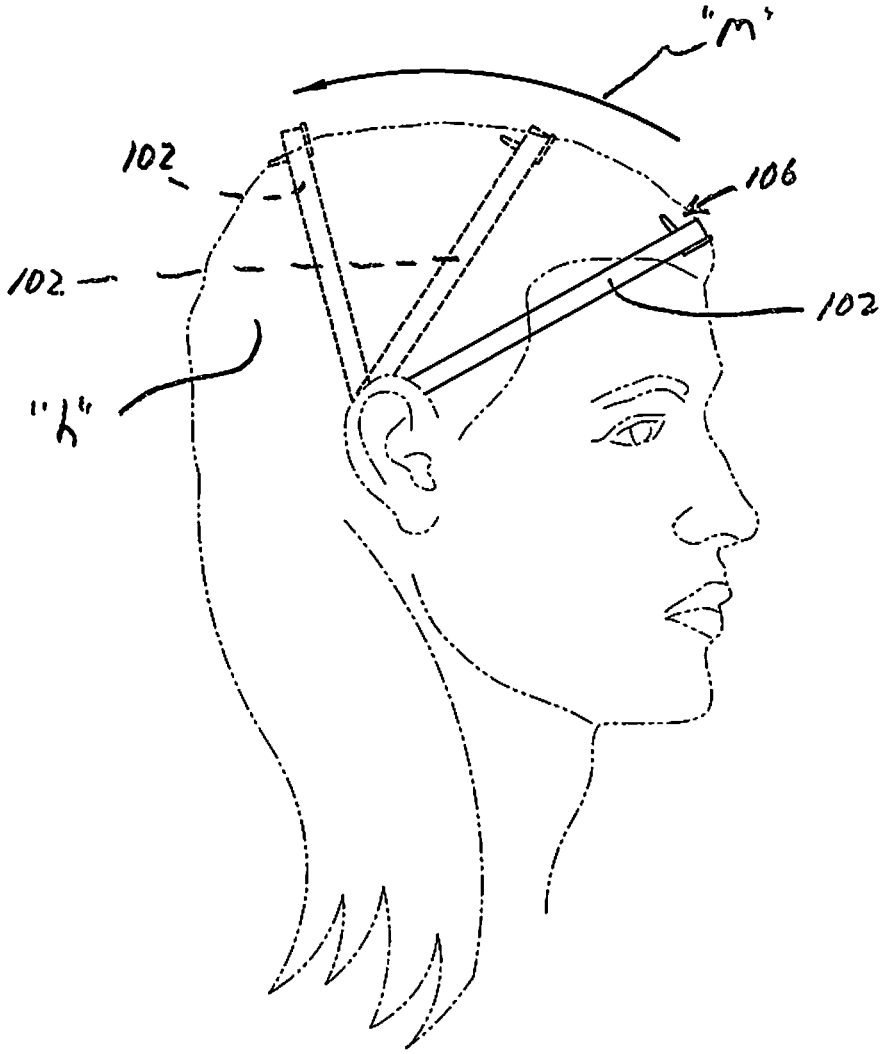
FIG. 6 is a view illustrating a sequence of application of the hair band apparatus to the head of the subject.

FIGS. 2, 4 and 6 illustrate a method of use of the hair band apparatus 100. In use, the hair "h" may be combed and the hair band member 102 placed around the front of the subject's head. The hair band member 102 is then manipulated through the hair "h", e.g., from front to back (directional arrow "m"), whereby the divider segment 112 gradually separates and imparts a part in the subject's hair "h" and while the hair band member 102 applies tension to the hair to pull the hair back or away from the subject's face. The hair band apparatus 100 is released and is retained on the subject's head in response to the resiliency of the hair band member 102. The parting member 106 in combination with the tension placed on the hair 'h" by the hair band member 102 maintains a clean clear part within the subject's hair "h".

In the embodiment of FIGS. 1-6 only a single or sole parting member 110 is provided. It is envisioned that multiples parting members may be spaced along the hair band member 102 if desired.

Figure 7:
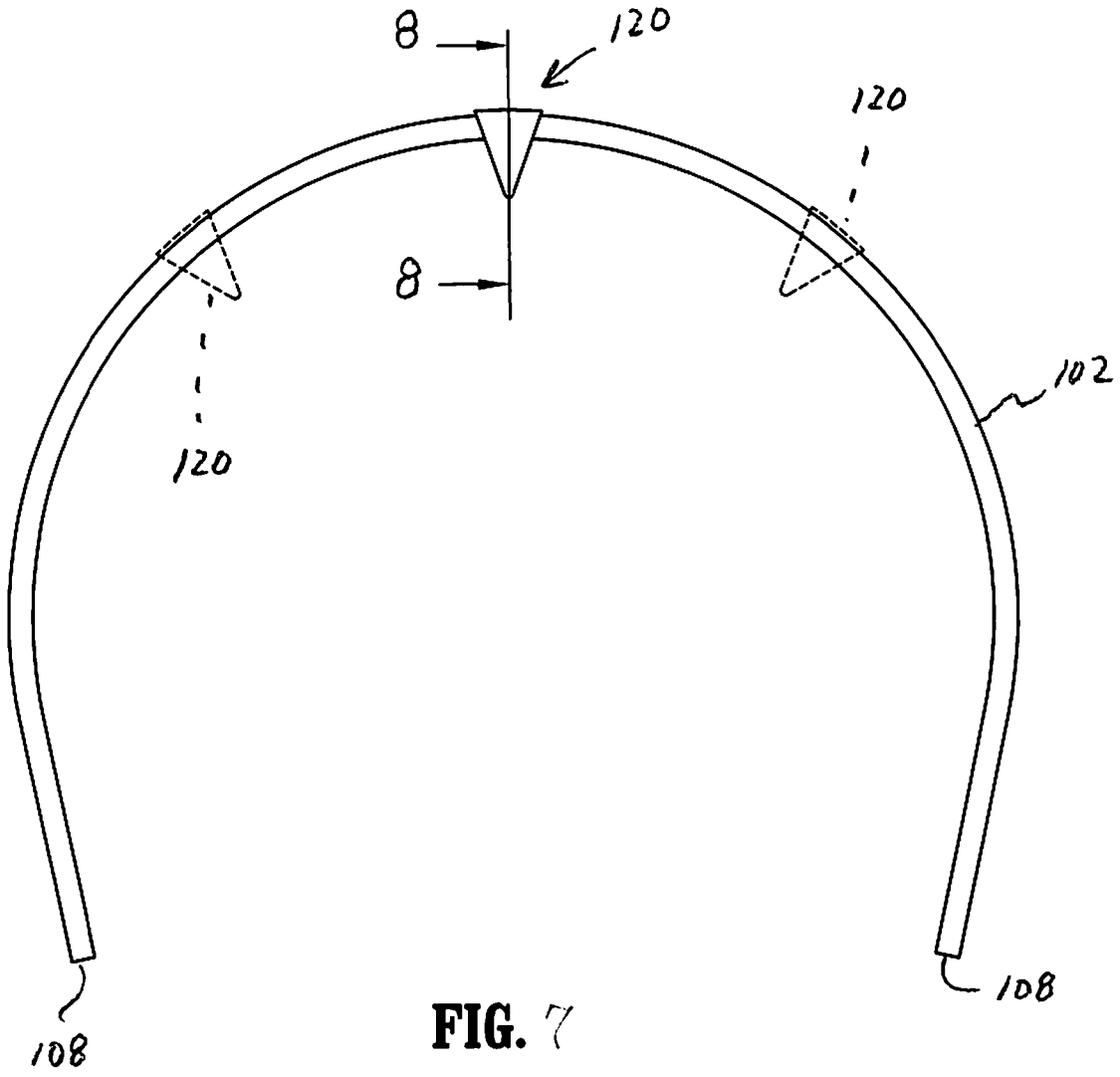
FIG. 7 is a plan view of an alternate embodiment of the hair band apparatus incorporating a parting member movably mounted on the hair band member to create parts within different locations in the hair of the subject.
Figure 8:
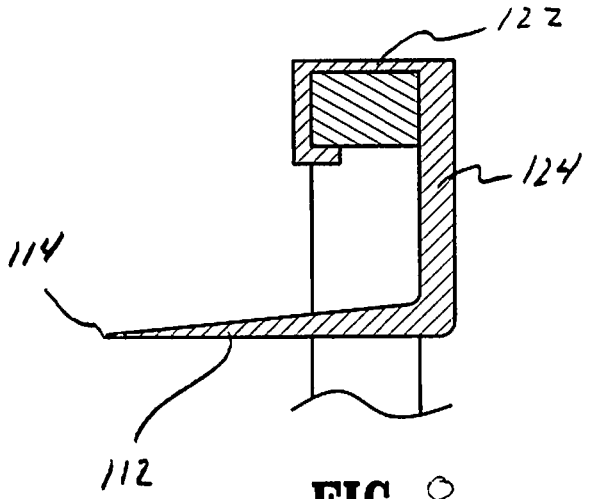
FIG. 8 is a cross-sectional view of the parting member taken along the lines 8-8 of FIG. 7.

FIGS. 7-8 illustrate an alternate embodiment of the hair band apparatus. In accordance with this embodiment, the hair parting member 120 is mounted for movement along the hair band member 102 to provide flexibility and versatility to the subject to achieve other desired styling effects. The hair parting member 120 is substantially similar to the hair parting member 104 of the embodiment of FIGS. 1-6 but includes a u-shaped mount 122 within connector segment 124. The u-shaped mount 122 is at least partially positioned about the outer perimeter of the hair band member 102 and may slide relative to the hair band member 102 to assume any multitude of positions (several shown in phantom) along the hair band member 102 to provide side parts, inclined parts, etc. In one embodiment, the mount 122 is dimensioned to establish a friction fit with the hair band member 102 such that the parting member 120 can be moved and retained in the desired position through a frictional relationship established between the components. An elastomeric layer may be added to either or both the mount 122 and the hair band member 102 to increase the frictional forces between the components. Other means for securing the parting member 120 and the hair band member 102 are envisioned including detent mechanisms, snap fit or the like.

The above description and the drawings are provided for the purpose of describing embodiments of the present disclosure and are not intended to limit the scope of the disclosure in any way. It will be apparent to those skilled in the art that various modifications and variations can be made without departing from the spirit or scope of the disclosure. Thus, it is intended that the present disclosure cover the modifications and variations of this disclosure provided they come within the scope of the appended claims and their equivalents.

What is claimed is:

1. A hair apparatus, which comprises:

a hair band member configured for positioning on a head of a subject, the hair band member comprising a length and a width extending between free opposing ends such that the hair band forms an elongated shape, and the length of the hair band defining a longitudinal axis of the hair band; and an individual parting member coupled to the hair band member between the opposed free ends, the individual parting member configured to form a part in the subject's hair when the hair band member is positioned on the subject's head, the individual parting member comprising:

a connector portion defined by a first end coupled to the hair band member and an opposing second end, the first end coupled to the hair band member and extending along a thickness direction of the hair band member; and a divider portion coupled to and extending orthogonally from the second end of the connector portion, the divider portion extending along a width direction of the hair band member and defining a cross-section that decreases toward a free distal end.

2. The hair apparatus according to claim 1 wherein the divider portion has a generally tapered tip portion to facilitate separating hair strands as the single parting member passes thought the subject's hair.

3. The hair apparatus according to claim 2 wherein the divider portion of the individual parting member is generally wedge-shaped.

4. The hair apparatus according to claim 1 wherein the individual parting member is centrally located relative to the hair band member equidistantly spaced relative to the opposed free ends.

5. The hair apparatus according to claim 4 wherein the individual parting member is fixed to the hair band member.

6. A hair apparatus, which comprises:

a hair band member configured for positioning on a head of a subject, the hair band member comprising a length and a width extending between free opposing ends such that the hair band member forms an elongated shape, and the length of the hair band member defining a longitudinal axis of the hair band member; and an individual parting member coupled to the hair band member, the individual parting member configured to form a part in the subject's hair when the hair band member is positioned on the subject's head, the individual parting member being movably mounted along the hair band member to be selectively positioned in a multitude of positions relative to the hair band member intermediate the opposed free ends to vary a location of a part formed in the subject's hair by the individual parting member, the individual parting member comprising a connector portion defined by a first end coupled to the hair band member and an opposing second end, the first end coupled to the hair band member and extending along a thickness direction of the hair band member, a divider portion coupled to and extending orthogonally from the second end of the connector portion, the divider portion extending along a width direction of the hair band member and defining a cross-section that decreases toward a free distal end.

7. The hair apparatus according to claim 1 wherein the divider portion defines a lower surface for contacting the head of the subject, the lower surface being spaced from the hair band member a predetermined distance toward the central longitudinal axis and disposed within a central opening of the band member.

8. The hair apparatus according to claim 7 wherein the lower surface of the divider portion is configured to extend in a direction parallel to the longitudinal axis of the hair band member.

9. The hair apparatus according to claim 2 wherein the divider portion defines the cross-section which is orthogonal to the longitudinal axis of the hair band member and which increases at least one of height or width along at least a major portion of a longitudinal length of the divider portion.

10. The hair apparatus according to claim 1 including a plurality of individual parting members spaced along the hair band member, each individual parting member being fixed relative to the hair band member.

11. The hair apparatus according to claim 6 wherein the individual parting member includes a mount portion, the mount portion defining a recess for reception of the hair band member to mount the individual parting member to the hair band member, the mount portion slidable along an outer perimeter of the hair band member to permit the single parting member to assume at least one of the multitude of positions relative to the hair band member.

12. The hair apparatus according to claim 11 wherein one of the mount portion or the outer perimeter of the hair band member includes an elastomeric member configured to establish a frictional relationship between the mount and the outer perimeter of the hair band member to assist in retaining the individual parting member at one of the multitude of positions.

13. The hair apparatus according to claim 6 wherein the divider portion of the individual parting member comprises a generally tapered tip portion to facilitate separating hair strands as the individual parting member passes thought the subject's hair.

14. The hair apparatus according to claim 13 wherein the individual parting member defines a lower surface for contacting the head of the subject, the lower surface being spaced from the hair band member a predetermined distance toward the longitudinal axis.

15. The hair apparatus according to claim 14 wherein the individual parting member includes a wedge-shaped portion, the wedge-shaped portion including the tapered tip portion.

16. The hair apparatus according to claim 15 wherein the wedge-shaped portion of the individual parting member defines a cross-section which increases along a major portion of a longitudinal length of the wedge-shaped portion.

17. The hair apparatus according to claim 16 including a plurality of individual parting members spaced along the hair band member, each individual parting member being movable relative to the hair band member to assume at least one of the multitude of positions relative to the hair band member and intermediate the opposing band ends.

18. The hair apparatus according to claim 9 wherein the divider portion defines a cross-section which increases in both height and width along the at least a major portion of the longitudinal length of the divider portion.

19. The hair apparatus according to claim 11 wherein the mount portion of the individual parting member and the outer perimeter of the hair band member include cooperating structure to assist in retaining the individual parting member at one of the multitude of positions.

20. The hair apparatus according to claim 6 including a plurality of individual parting members on the hair band member.

* * * * *